US007322720B1

(12) United States Patent
Haddad

(10) Patent No.: US 7,322,720 B1
(45) Date of Patent: Jan. 29, 2008

(54) TRADITIONAL STYLE POST-TOP LUMINAIRE WITH RELAMPING MODULE AND METHOD

(75) Inventor: Eric Haddad, East Berlin, PA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 0 days.

(21) Appl. No.: 11/424,935

(22) Filed: Jun. 19, 2006

(51) Int. Cl.
*F21V 21/00* (2006.01)

(52) U.S. Cl. ..... 362/309; 362/363; 362/334; 362/374; 362/375; 362/362

(58) Field of Classification Search ..... None
See application file for complete search history.

(56) References Cited

U.S. PATENT DOCUMENTS

| | | | | |
|---|---|---|---|---|
| 1,045,852 | A | | 12/1912 | Jones |
| D51,774 | S | | 2/1918 | Coppinger |
| 1,357,539 | A | | 11/1920 | Bissell |
| 1,702,746 | A | | 2/1929 | Prichard |
| 2,007,033 | A | | 7/1935 | Williams |
| 2,080,120 | A | | 5/1937 | Everett |
| 2,259,307 | A | | 10/1941 | Herbold |
| 2,474,327 | A | | 6/1949 | Rolph |
| 2,566,126 | A | | 8/1951 | Franck |
| 2,758,199 | A | | 8/1956 | Yonkers |
| 2,836,709 | A | | 5/1958 | Van Dusen, Jr. |
| 2,960,361 | A | | 11/1960 | Boutelle |
| 3,040,994 | A | | 6/1962 | Anderson et al. |
| 3,096,029 | A | | 7/1963 | Berge |
| 3,189,736 | A | | 6/1965 | McPhail |
| 3,202,070 | A | | 8/1965 | Pratt, Jr. et al. |
| 3,222,509 | A | * | 12/1965 | Thedford ..... 362/152 |
| 3,283,138 | A | | 11/1966 | Huber et al. |
| 3,297,865 | A | | 1/1967 | Baldwin |
| 3,299,265 | A | | 1/1967 | Rackley et al. |
| 3,299,591 | A | | 1/1967 | Woelk |
| 3,317,724 | A | * | 5/1967 | Kepenach et al. ..... 362/311 |
| 3,321,619 | A | * | 5/1967 | Dailey ..... 362/367 |
| 3,329,812 | A | | 7/1967 | Harling |
| 3,340,393 | A | | 9/1967 | Franck et al. |
| 3,347,008 | A | | 10/1967 | Strengholt |
| 3,395,273 | A | | 7/1968 | Welty |

(Continued)

*Primary Examiner*—Sandra O'Shea
*Assistant Examiner*—Danielle Dunn
(74) *Attorney, Agent, or Firm*—John F. Salazar; Middleton Reutlinger

(57) ABSTRACT

A luminaire adapted to being mounted at the top of a post having a design reducing maintenance costs. The luminaire has a capital with a globe mounted thereon forming an optical chamber, the capital has a front access area with a front access door hingedly attached thereto and optionally has a tool-less latch capable of holding the front access door over the front access area. The capital has an opening in a top portion thereof into the optical chamber, optionally, a relamping module extends from the inside of the capital, through the opening and up into a central portion of the optical chamber and has a lamp socket thereon. The relamping module may be removed without manipulation of the globe or globe roof. The luminaire may also have electrical gear within the capital attached to a tray wherein the tray is removably attached to an internal portion of the capital. The globe and globe roof may remain stationary during typical maintenance processes such as relamping or maintenance of electrical gear.

26 Claims, 10 Drawing Sheets

U.S. PATENT DOCUMENTS 3,413,462 A 11/1968 Spero
3,461,283 A 8/1969 Hahn
3,529,148 A 9/1970 Stefano et al.
3,530,287 A 9/1970 Husby
3,543,016 A 11/1970 Jones
3,610,942 A * 10/1971 Arens ..... 250/237 R
3,701,898 A 10/1972 McNamara, Jr.
3,711,702 A 1/1973 Adra
3,761,781 A * 9/1973 Dean ..... 361/674
3,766,375 A 10/1973 Edman et al.
3,940,898 A 3/1976 Kaufman
3,990,201 A 11/1976 Falbel
3,991,905 A 11/1976 Nicpon
4,001,572 A 1/1977 Stein
4,001,778 A 1/1977 Ross
4,015,394 A 4/1977 Kessler
4,027,151 A 5/1977 Barthel
4,029,630 A 6/1977 Meinhold et al.
4,029,955 A 6/1977 Tart
4,090,210 A 5/1978 Wehling et al.
4,091,444 A 5/1978 Mori
4,118,763 A 10/1978 Osteen
4,141,061 A 2/1979 Ford et al.
4,143,412 A 3/1979 Sassmannshausen
4,143,413 A 3/1979 Kelly
4,155,111 A 5/1979 Kelly et al.
4,164,784 A 8/1979 Jaksich
4,173,037 A 10/1979 Henderson, Jr. et al.
4,213,170 A 7/1980 Kimball et al.
4,218,727 A 8/1980 Shemitz et al.
4,229,782 A 10/1980 Ruud et al.
4,234,912 A 11/1980 Barnes et al.
4,240,853 A 12/1980 Pustka
4,242,725 A 12/1980 Douma et al.
4,261,030 A 4/1981 Hernandez
4,293,901 A 10/1981 Hernandez
4,310,876 A 1/1982 Small, Jr. et al.
4,318,237 A 3/1982 Hicks
4,323,954 A 4/1982 Florence et al.
4,323,956 A 4/1982 Pustka
4,360,863 A 11/1982 Barnes et al.
4,364,108 A 12/1982 Rapp
4,395,750 A 7/1983 Scheidemann et al.
4,434,455 A 2/1984 Merritt
4,447,863 A 5/1984 Fenne
4,450,660 A 5/1984 Dean et al.
4,459,789 A 7/1984 Ford
4,471,411 A 9/1984 Graham et al.
4,480,809 A 11/1984 Healey
4,527,224 A 7/1985 Sangiamo et al.
4,531,180 A 7/1985 Hernandez
4,546,420 A 10/1985 Wheeler et al.
4,602,320 A 7/1986 Tomkin et al.
4,626,975 A 12/1986 Miletich
4,717,991 A 1/1988 Murphree, Jr.
4,719,548 A * 1/1988 Orosz ..... 362/309
4,766,709 A 8/1988 Galbraith
4,786,344 A 11/1988 Beuther
4,816,969 A 3/1989 Miller
4,839,781 A 6/1989 Barnes et al.
4,893,224 A 1/1990 Tinley
5,016,150 A 5/1991 Gordin et al.
5,062,029 A 10/1991 Engel
5,081,569 A 1/1992 Quiogue et al.
5,099,405 A 3/1992 Gehly et al.
5,111,371 A 5/1992 Nielson
5,140,507 A 8/1992 Harwood
5,183,331 A 2/1993 Edgell et al.
5,243,508 A * 9/1993 Ewing et al. ..... 362/431
5,278,737 A 1/1994 Luce et al.
5,289,358 A 2/1994 Halemeier
D348,745 S 7/1994 Ewing et al.
5,377,087 A 12/1994 Yoon
5,404,297 A 4/1995 Birk et al.
5,416,684 A 5/1995 Pearce
5,434,765 A 7/1995 Kelly et al.
5,435,087 A 7/1995 Karkar et al.
5,444,606 A 8/1995 Barnes et al.
5,446,637 A 8/1995 Cunningham et al.
5,450,303 A 9/1995 Markiewicz et al.
5,481,445 A 1/1996 Sitzema et al.
D370,228 S 5/1996 Chapman et al.
5,572,819 A 11/1996 Topinka et al.
5,642,934 A 7/1997 Haddad
5,704,710 A 1/1998 Greene et al.
D390,994 S 2/1998 Ewing et al.
D390,995 S 2/1998 Ewing et al.
D391,383 S 2/1998 Ewing et al.
5,722,770 A 3/1998 Douglas
5,743,632 A 4/1998 Carl
D400,277 S 10/1998 Ewing et al.
5,826,975 A 10/1998 Hsieh et al.
5,947,591 A 9/1999 Katsumata et al.
5,997,158 A 12/1999 Fischer et al.
6,017,131 A 1/2000 Goins
D424,736 S 5/2000 Johnson
6,121,897 A * 9/2000 Flegel ..... 340/907
6,168,300 B1 1/2001 Fischer et al.
6,337,792 B1 * 1/2002 George ..... 361/674
6,382,818 B1 5/2002 Iwama et al.
6,402,352 B1 6/2002 Summerford et al.
6,450,657 B1 9/2002 Testa et al.
6,491,415 B2 12/2002 Orellana
6,494,596 B1 12/2002 Burroughs
D469,565 S 1/2003 Anderson et al.
6,575,601 B1 6/2003 Sitzema, Jr. et al.
6,698,908 B2 3/2004 Sitzema, Jr. et al.
6,786,619 B2 9/2004 Subisak et al.
6,796,687 B2 9/2004 Hudak et al.
6,840,658 B2 1/2005 Anderson et al.
6,971,772 B1 12/2005 Abdelsamed et al.
6,974,235 B2 12/2005 Subisak
7,059,747 B2 6/2006 Barozzini et al.
7,121,684 B2 10/2006 Barozzini et al.
2005/0078483 A1 4/2005 Bernard et al.
2005/0117333 A1 6/2005 Yoshida et al.

* cited by examiner

TRADITIONAL STYLE POST-TOP LUMINAIRE WITH RELAMPING MODULE AND METHOD

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

This invention relates to a luminaire adapted to be mounted at the top of a post. More particularly, this invention is directed to a luminaire having a new and improved design reducing maintenance costs.

DETAILED DESCRIPTION OF THE PREFERRED EMBODIMENTS

To present a better understanding of the invention, particular embodiments thereof will now be described and illustrated in the Figures. Reference to the Figures showing embodiments of the presently claimed invention are made simply to describe the presently claimed invention and not to limit the scope of the claims herein.

A traditional style post-top luminaire is provided having a design reducing maintenance costs. Optionally, the luminaire has a substantially isolated water and dust tight optical chamber and may incorporate a unique design of tool-less access to a re-lamping module and/or a removable electrical gear tray. Incorporating each of these options provides access to substantially all internal components through a hinged door on a bottom luminaire capital without the need for tools.

A sealed optical chamber is achieved by gasketing between the roof, globe, and bottom luminaire capital. Preferably, a dual radial sealed removable socket casting allows for tool-less removal of a lamp and relamping via access to a relamping module. The dual radial sealing method for a re-lamping module is preferably a submersible rated gasketing method. The relamping module has a relamping post extending upward from a base cooperating with a central portion of a radial sealed socket casting and has a lamp socket thereon. Electrical gear is preferably attached to a removable tray mounted in the capital which is removable and replaceable in a tool-less manner.

A user has access to the lamp for replacement and servicing of the electrical gear at the same time via an optional tool-less latch through a bottom capital. Thus, a post-top luminaire may have totally tool-less access and the capability to service most all of the components that require typical maintenance in a tool-less manner.

Figure 1:
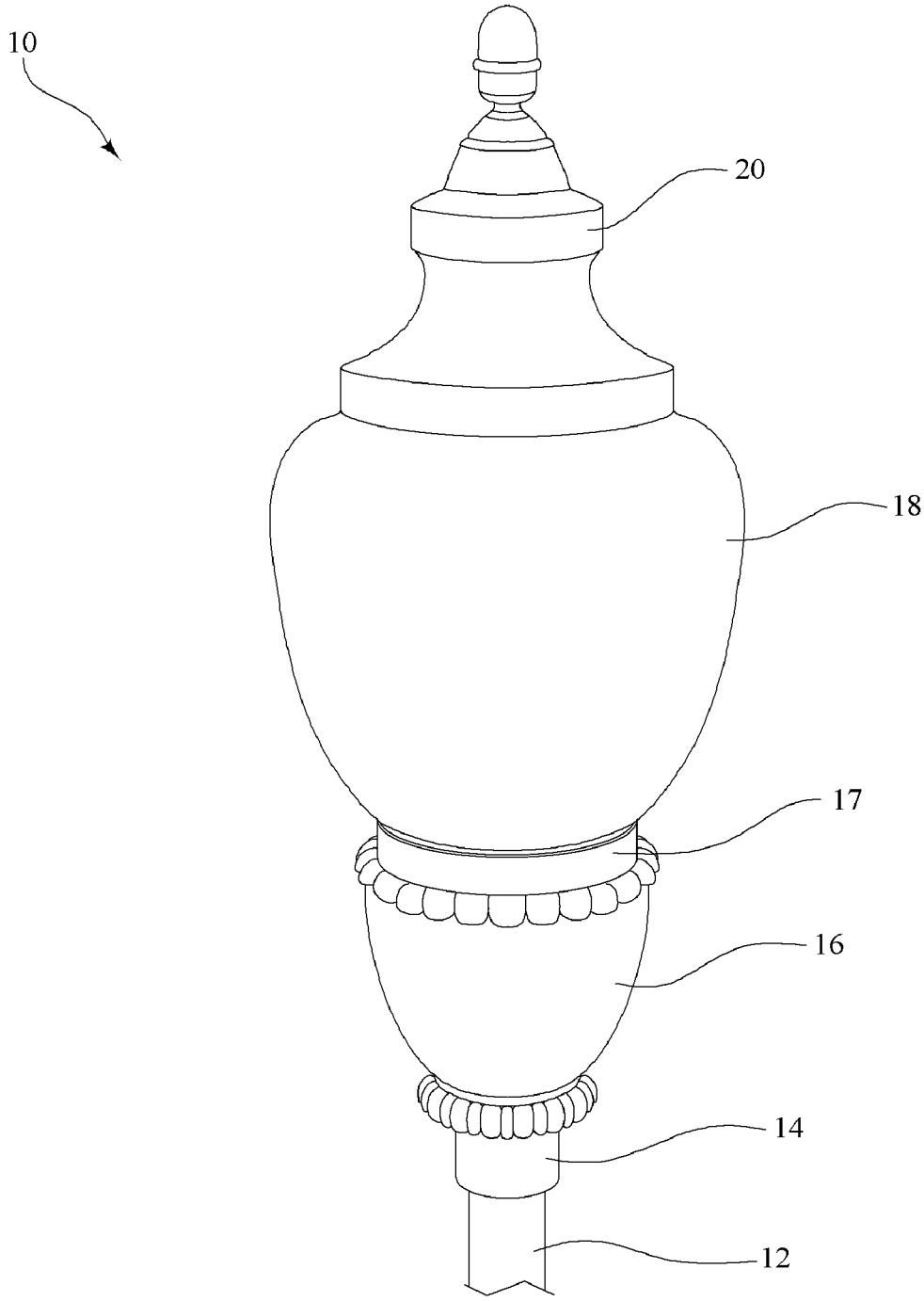
FIG. 1 is a perspective view of an embodiment of the luminaire mounted on the top of a post showing the external components thereof.

With reference to FIG. 1, luminaire 10 is illustrated in one position mounted at the top of a post 12. The external structure of the luminaire 10 is substantially symmetrical about a central vertical axis, and thus FIG. 1 illustrates the exterior of the luminaire 10 as perceptively viewed from substantially any side thereof. From an external perspective, luminaire 10 generally comprises a luminaire base 14 supporting a capital 16. Capital 16 has an opening in the top thereof wherein globe 18 is sealably retained forming an optical chamber within. Atop globe 18 is roof 20 which sealed to globe 18 forming an optical chamber substantially sealed off from the exterior environment. Roof 20 is optional as globe 18 could have a top without an opening therein. Preferably, globe 18 is an acorn globe.

Figure 2:
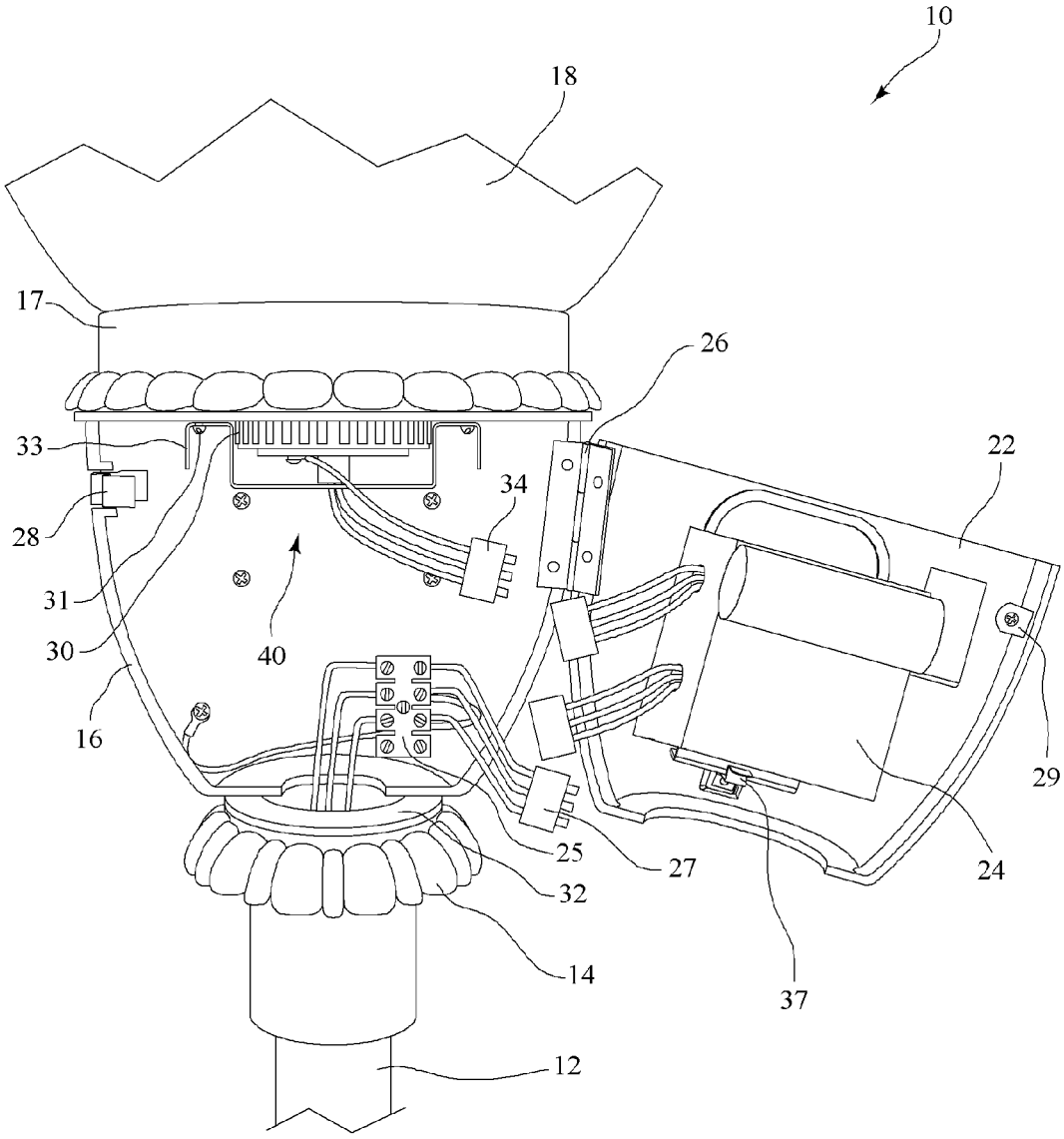
FIG. 2 is a view of the luminaire of FIG. 1 having a door in the capital being open showing the internal components thereof.
Figure 3:
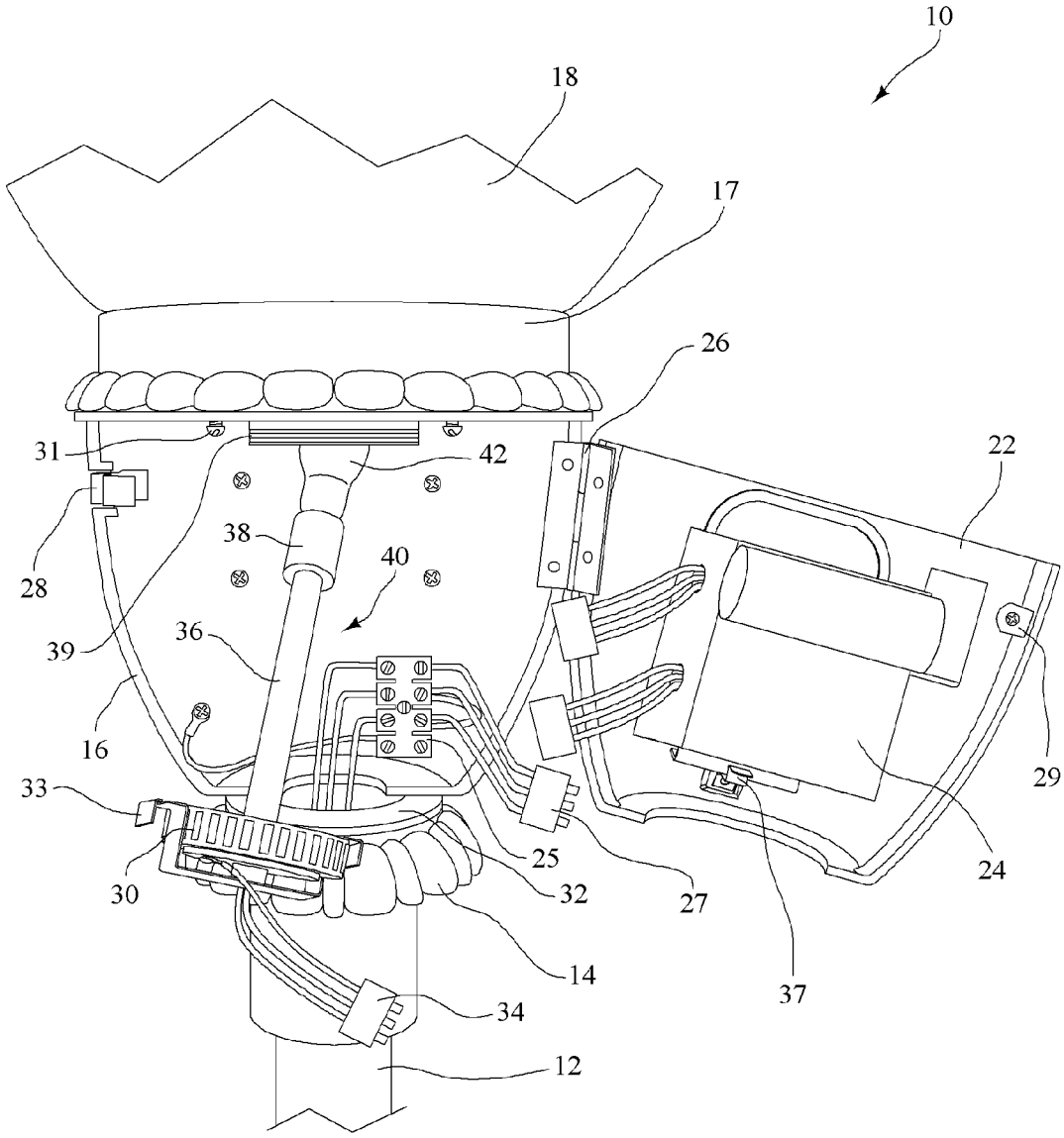
FIG. 3 is a view of the luminaire of FIG. 1 having a partial cutaway of the capital showing a gasket and the partial removal of a relamping module.

With reference to FIGS. 2 and 3, luminaire 10 has capital 16 attached to base 14 with cast top 32 there between. Base 14 resides atop post 12. Capital 16 has door 22 open showing the internal components therein. Electrical assembly 24 is removably retained within capital 16 with retainer 37, being retained on door 22, providing easy access and removability. Door 22 is attached to capital 16 via hinge 26. Tab 29 is attached near an edge of door 22 and is oriented to cooperate with tool-less latch 28 on capital 16 providing tool-less access to electrical gear assembly 24, relamping module 40, and other internal components thereof. FIG. 2 shows relamping module 40 in a sealed position within capital 16 about dual radial sealed socket casting 39 with relamping module sealing base 30. Relamping module sealing base 30 seals about dual radial sealed socket casketing 39 with a twisting action or vertical placement thereon. Optionally, threads are about an outer portion of dual radial sealed socket casting 39 which cooperate with optional threads on an inner surface of relamping module sealing base 30. FIG. 3 shows relamping module sealing base 30 released and removed from dual radial sealed socket casting 39 as is done when relamping. Relamping module 40 is shown partially removed exposing relamping post 36, socket 38, and lamp 42. Lamp electrical connection 34 is removed from electrical assembly 24 and optional retaining bracket 33 is rotatingly removed from retainers 31. Terminal block 25 resides within capital 16 and serves as a connector to an external power supply via wires extending through luminaire base 14 and post 12. Electrical connector 27 is in electrical communication with terminal block 25 and removed from electrical assembly 24. Outer globe ring 17 is shown having a decorative outer surface sealingly holding globe 18 on capital 16.

Figure 4:
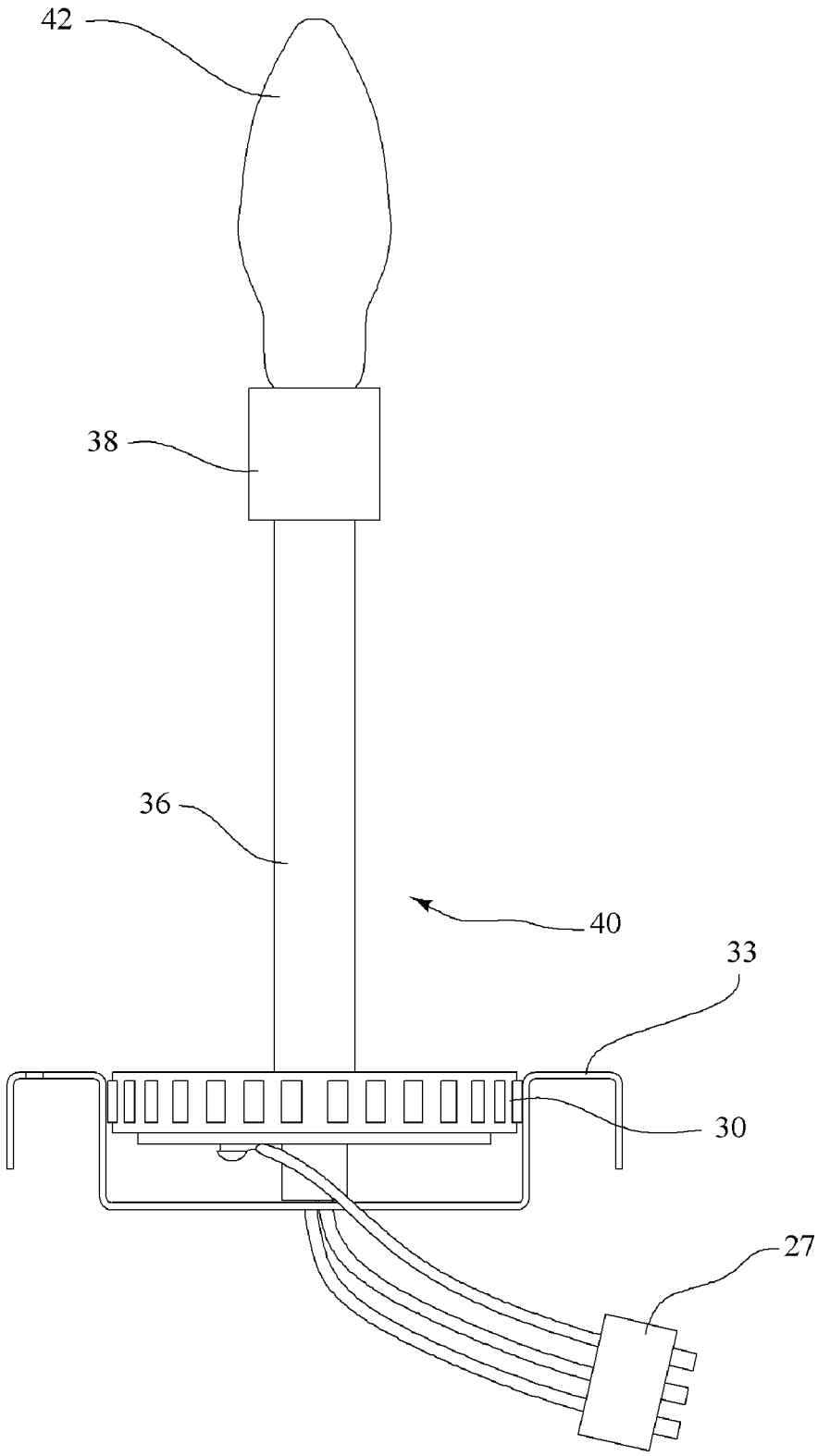
FIG. 4 is a view of the relamping module of the luminaire of FIG. 1.

FIG. 4 shows a relamping module 40. Relamping module 40 has at its base a relamping module sealing base 30 that has an inner circumferential surface which optionally seals to a an optional single or dual radial sealed socket casting. Optionally, relamping module sealing base 30 has an internal thread to cooperate with optional external threads on a dual radial sealed socket casting. Alternatively, relamping module sealing base 30 has a smooth inner surface enabling a vertical placement about a dual radial sealed socket casting. Extending upward from relamping module sealing base 30 is relamping post 36 which contains wiring for lamp 42 terminating at connector 27. Relamping post 38 has a length necessary to position lamp 42 within a central portion of globe 18 when relamping module sealing base 30 is sealed onto a dual radial sealed socket casting. Atop relamping post 36 is lamp socket 38 having lamp 42 installed therein. Depending from relamping module sealing base 30 is optional retaining bracket 33 that has slots in an upper portion for twistingly engaging fasteners downwardly depending from outer globe ring 17, shown in FIGS. 2 and 3.

Figure 5:
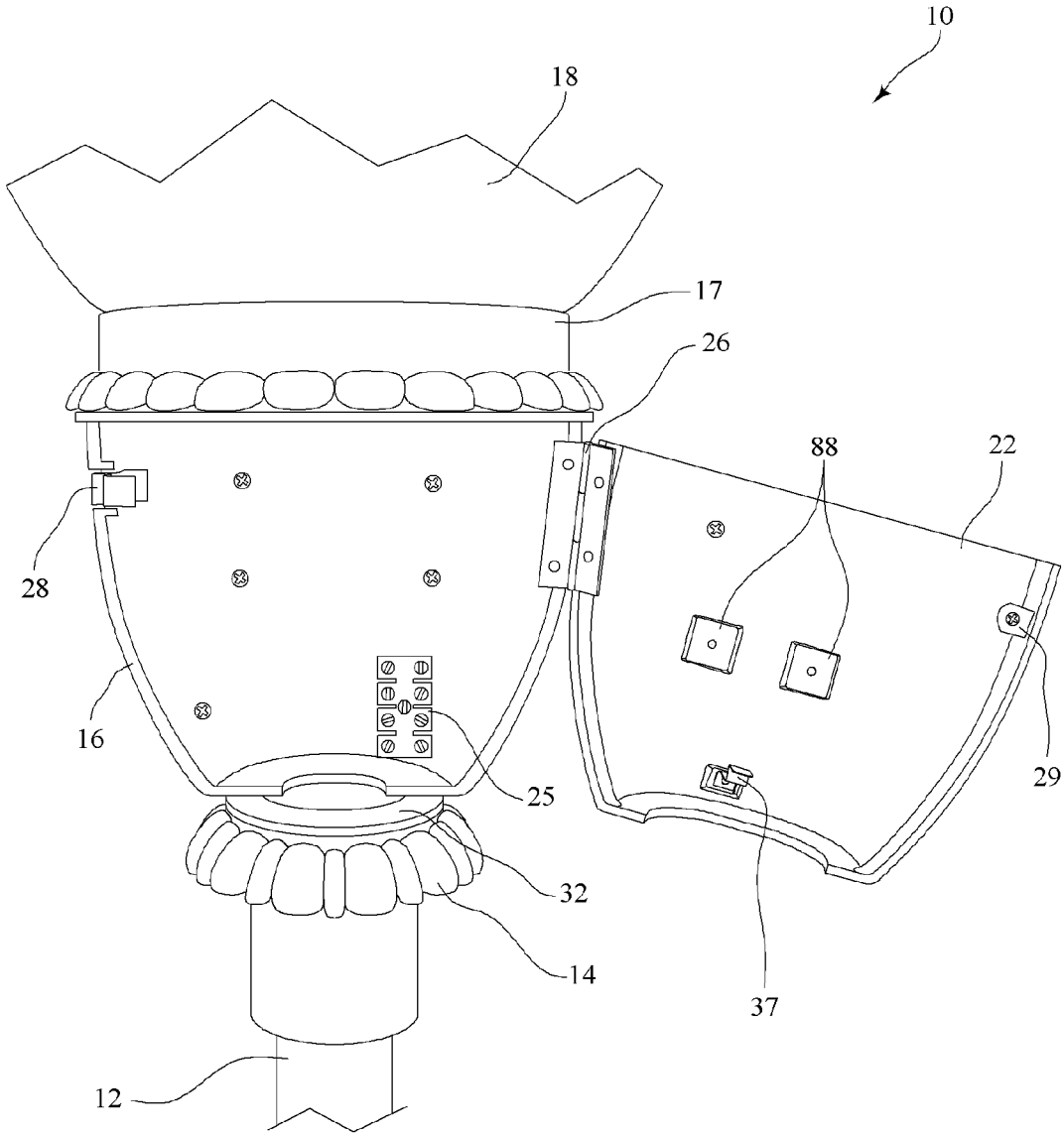
FIG. 5 is a view of the luminaire of FIG. 1 having a door in the capital being open showing the capital with internal components removed therefrom.

FIG. 5 shows a post top luminaire 10 having door 22 in capital 16 being open showing the internal components removed for maintenance. Capital 16 is attached to base 14 having cast top 32 and has globe 18 sealably retained thereon forming an optical chamber within. Base 14 resides atop post 12. Capital 16 has door 22 open showing electrical assembly 24 removed thereform showing mounts 88. Mounts 88 and retainer 37 enables for a tool-less removal and replacement of electrical assembly 24. Door 22 is attached via hinge 26. Tab 29 is attached near an edge of door 22 and is oriented to cooperate with tool-less latch 28 on capital 16 providing tool-less access to electrical assembly 24 and relamping module 40. Atop capital 16 is outer globe ring 17 holding globe 18 thereon. Terminal block 25 is shown attached an inner wall of capital 16 having all electrical wires removed therefrom.

Figure 6:
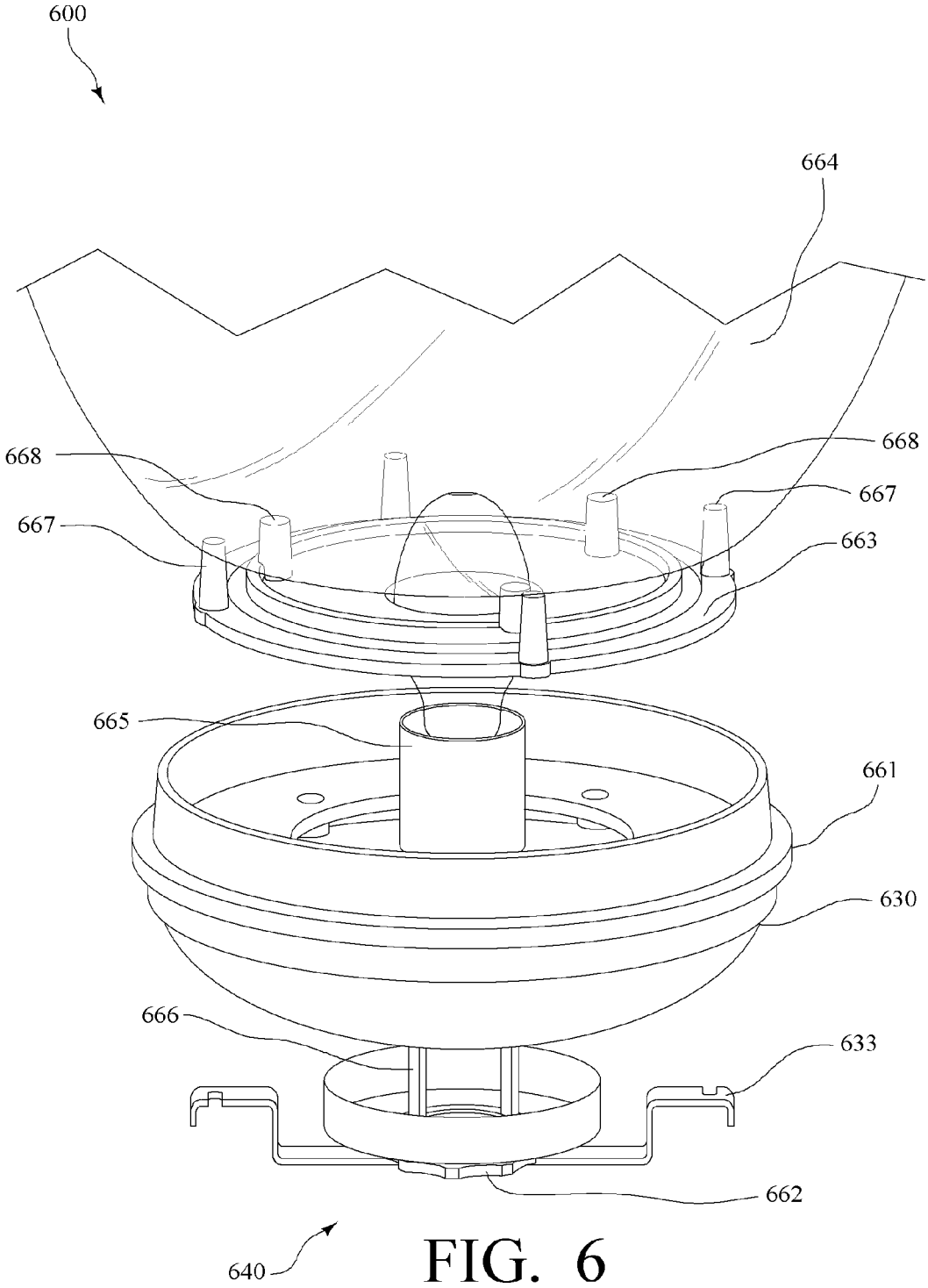
FIG. 6 is a cutaway view of a post-top luminaire showing the interrelationship between the relamping module and upper portion of the luminaire.

FIG. 6 shows post-top luminaire 600 having relamping module 640, outer globe ring 661, and inner globe ring 663 in an exploded view showing the interrelationship between these component parts. Relamping module 640 has retaining bracket 633 extending radially from relamping module sealing base 630. Retaining bracket 633 has notches proximate each end for twistingly engaging fasteners extending downward from outer globe ring 661. Depending upward from relamping module sealing base 630 is relamping post 666 having socket 665 mounted atop. Lamp 662 is threadingly engaged within lamp socket 665. Retainer receivers 668 preferably have an internal thread for receiving a fastener holding inner globe ring 663 to outer globe ring 661. Globe posts 667 extend upward from inner globe ring 663 supporting globe 664 thereon.

Figure 7:
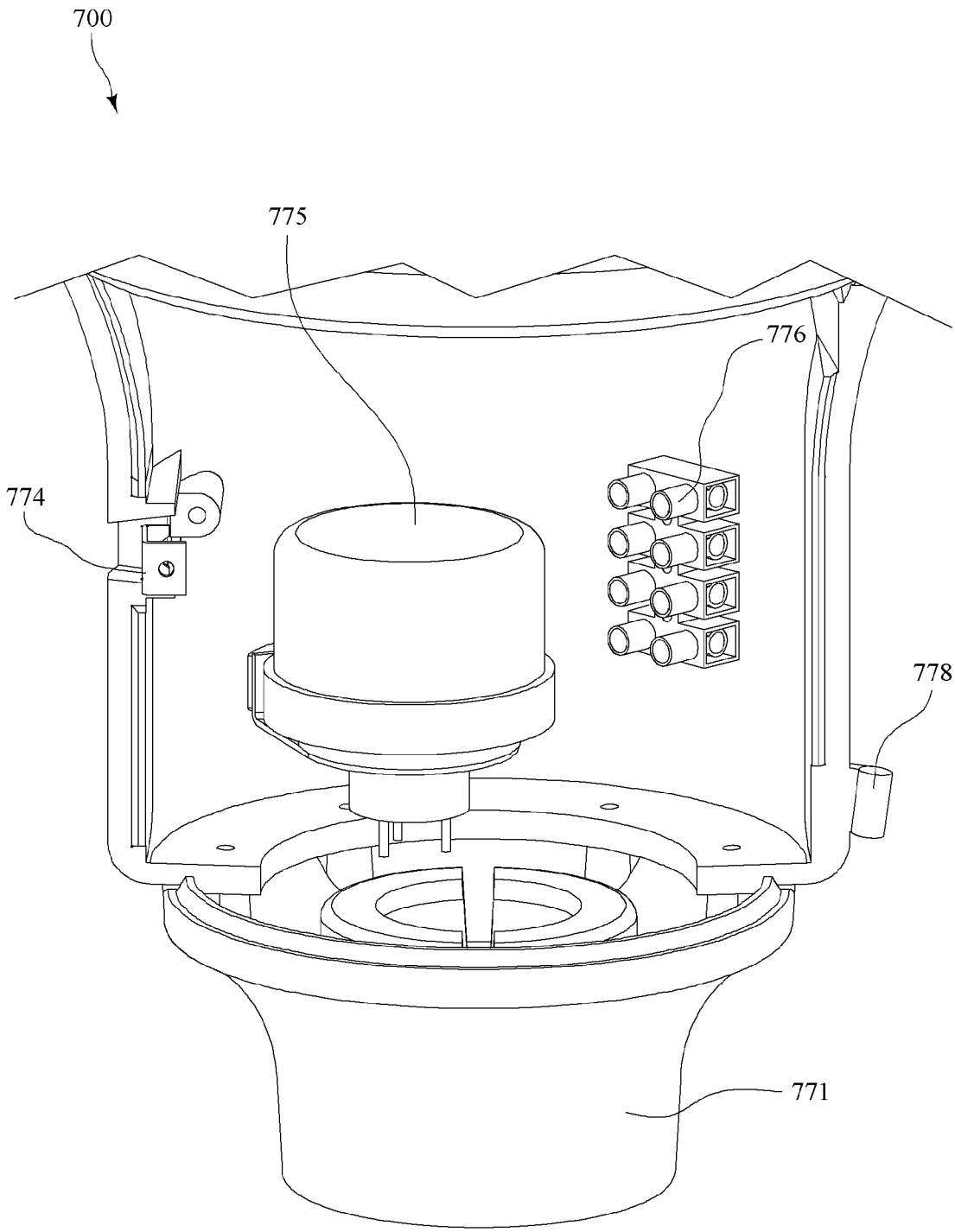
FIG. 7 is a cutaway view of a post-top luminaire showing a capital having a door removed and installed on a base for mounting atop a post.
Figure 8:
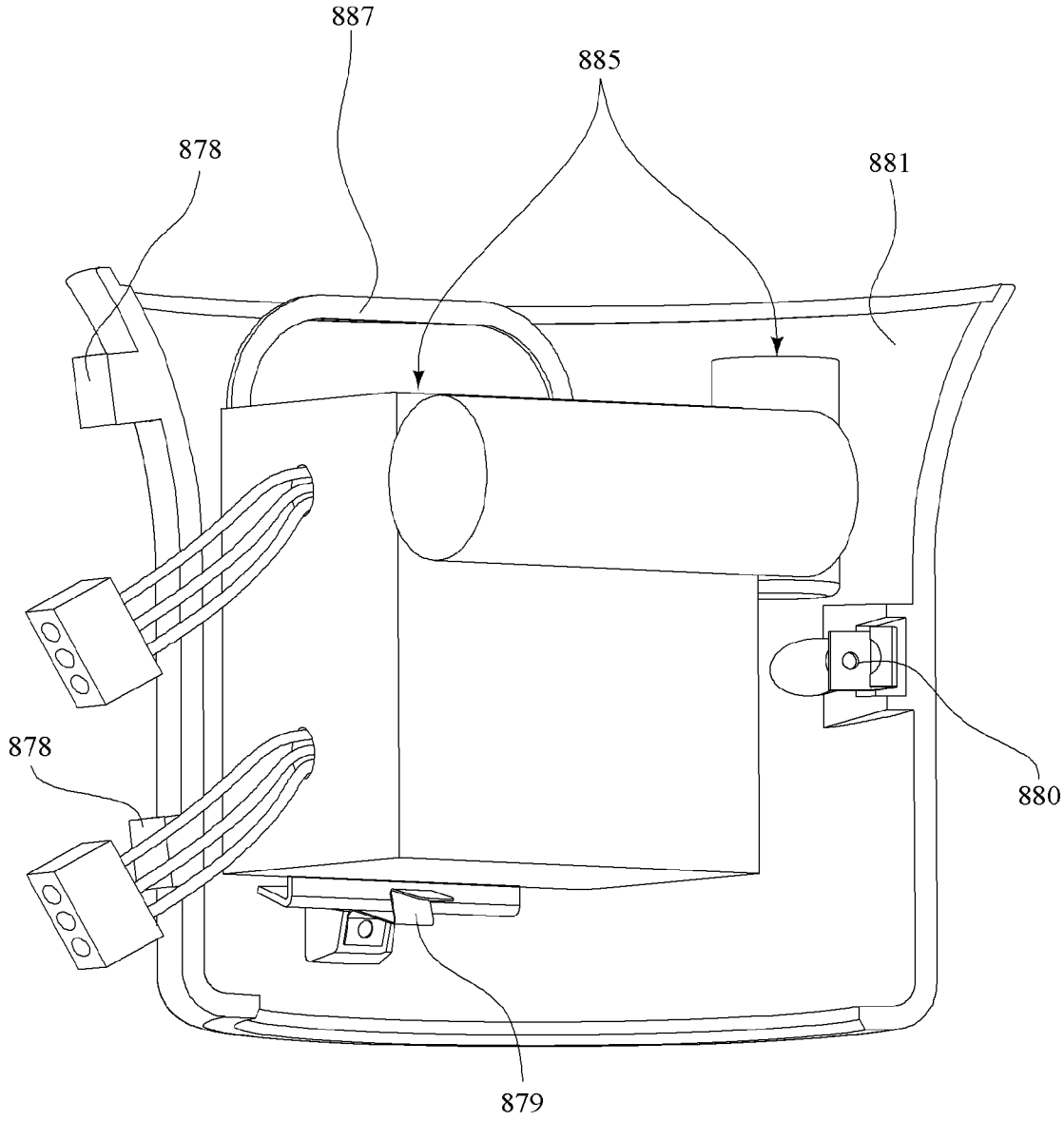
FIG. 8 is a perspective view of a capital door with electrical components mounted therein.

FIG. 7 shows post-top luminaire 700 having capital 770 with a door removed therefrom. Capital 770 is mounted on luminaire base 771 for mounting atop a post. Tool-less latch 774 is near an edge of capital 770 proving tool-less access to the inner portion of capital 770 by holding a door, shown in FIG. 8, in a closed position. On an opposite edge of capital 770 is hinge component 778 for hingedly holding the door. Internal components shown within capital 770 are optional photo control 775 and terminal block 776. FIG. 8 shows capital door 881 with electrical assembly 885 removeably mounted therein. Capital door 881 has latch 879 on a lower inner portion thereof cooperating with electrical assembly 885 providing for the tool-less removable of electrical assembly 885. Electrical assembly 885 has handle 887 extending from an upper portion for tool-less removal. Lower and upper hinge components 878 cooperate with hinge components 778 on capital 700, shown in FIG. 7. Tab 880 cooperates with tool-less latch 774 providing tool-less access to the internal components of luminaire 700 having door 881.

Figure 9:
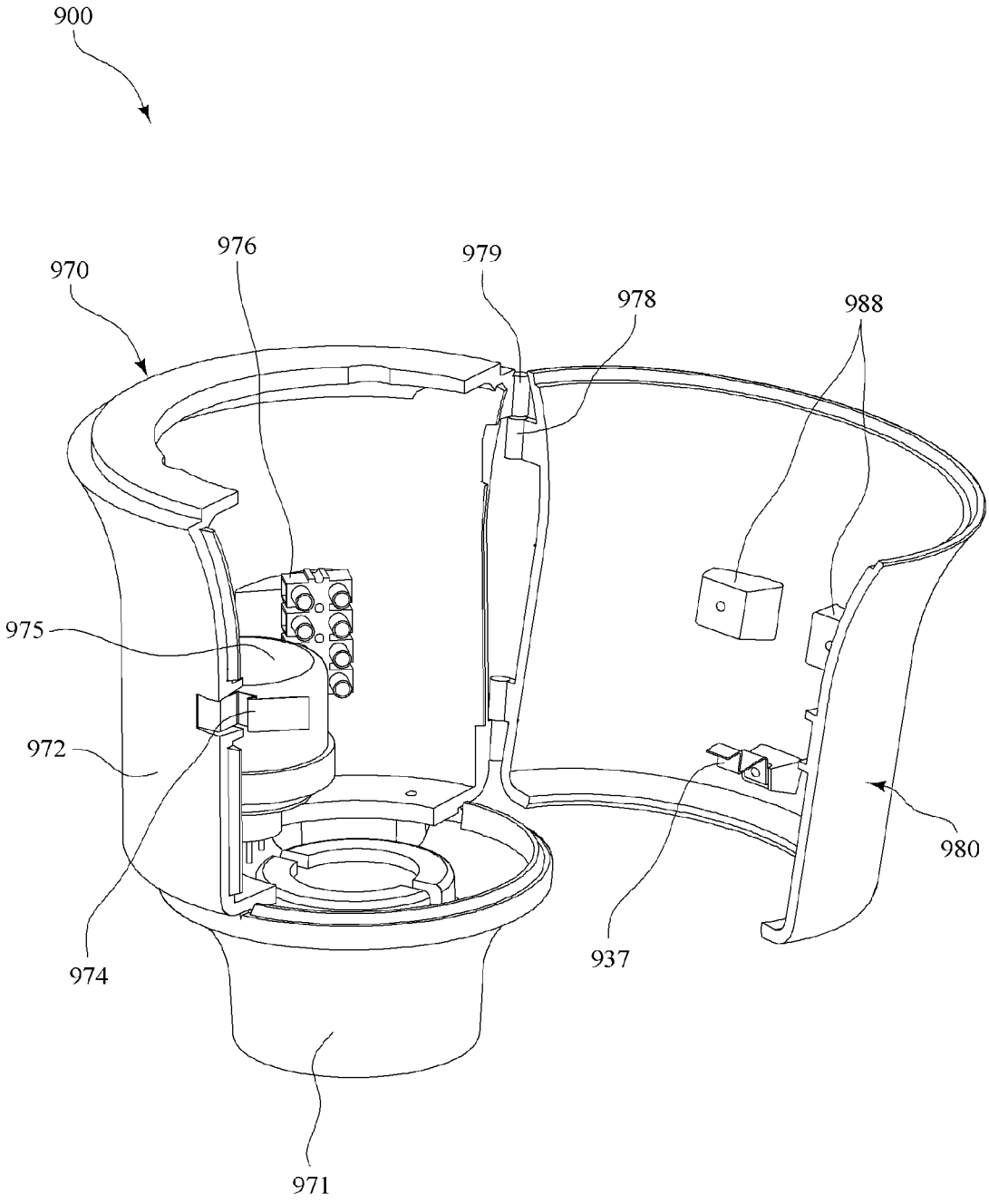
FIG. 9 is a perspective view of the capital of FIG. 7 having the capital door of FIG. 8 mounted thereon.

FIG. 9 shows post-top luminaire 900 having capital 970 with capital door 980 hingedly attached thereto. Capital 970 is mounted on luminaire base 971 for mounting atop a post. Tool-less latch 974 is near an edge of capital 970 proving tool-less access to the inner portion of capital 970 and capital door 980. Hinge components 978 and 979 cooperate to hingedly hold capital door 980 to capital 970. Internal components shown within capital 970 are optional photo control 975 and terminal block 976. Capital door 980 has an electrical assembly removed thereform exposing mounting blocks 988 and latch 937 which cooperate with the electrical assembly providing tool-less removal.

Figure 10A:
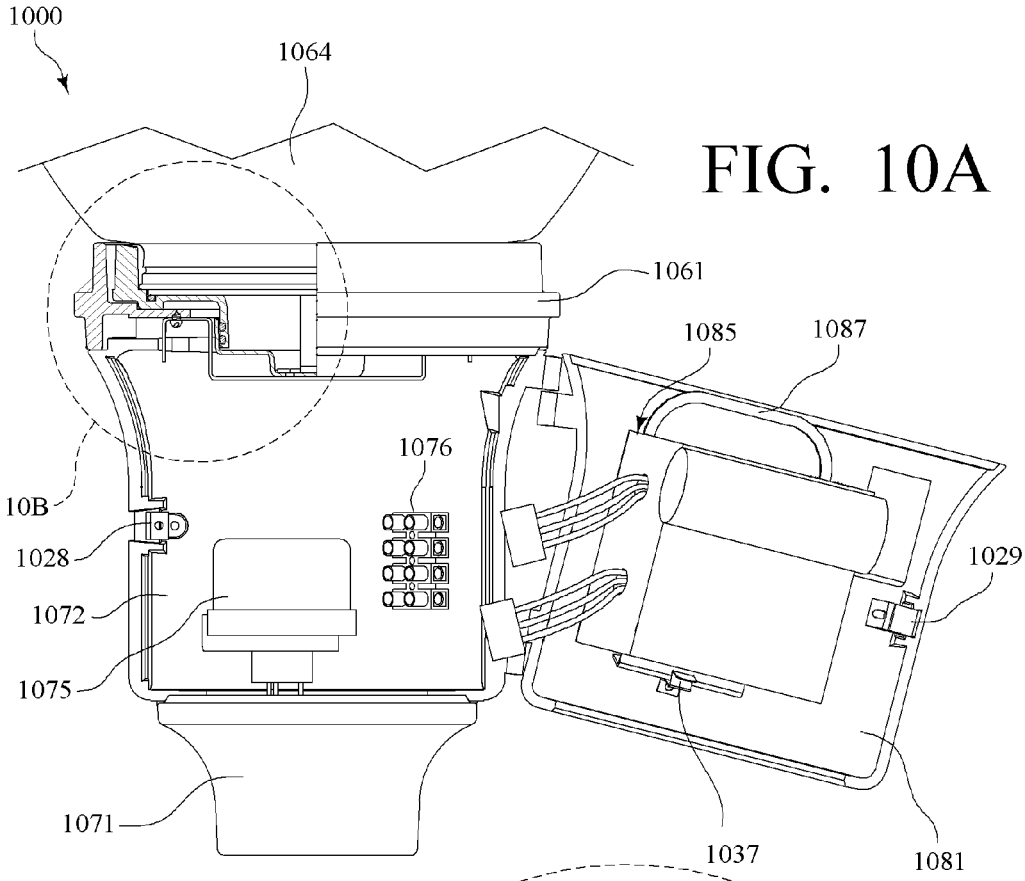
FIGS. 10A and 10B is a partial cut-away view of a post top luminaire showing the dual radial sealing method and cooperation between the upper components of the luminaire.
Figure 10B:
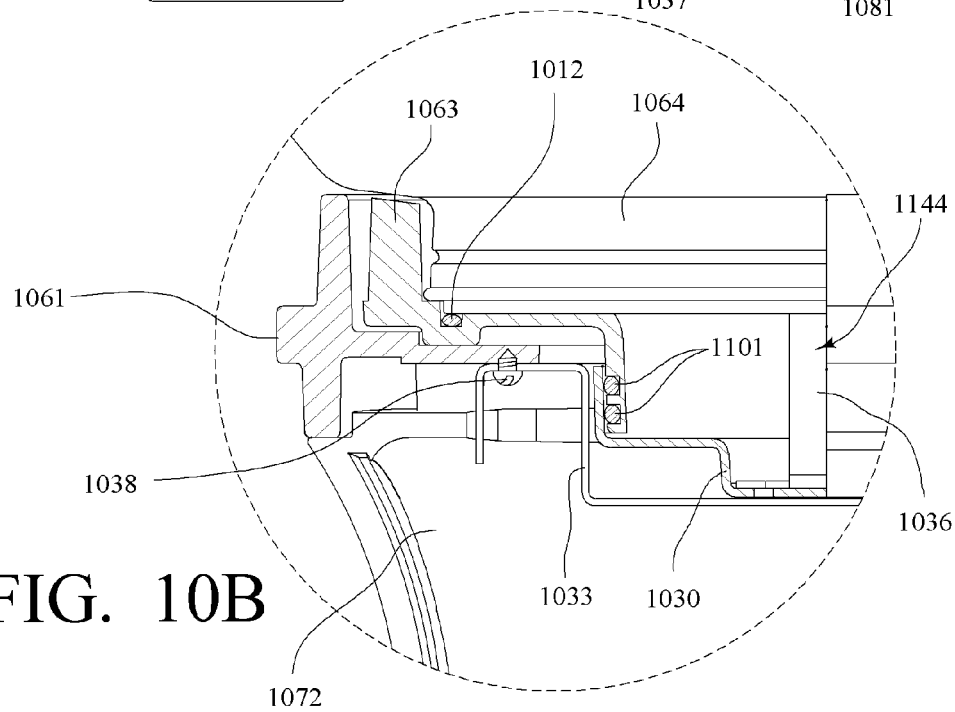

FIGS. 10A and 10B show a partial cut-away view of post top luminaire 1000 detailing the dual radial sealing method and cooperation between the capital 1072, outer globe ring 1061, inner globe ring 1063, relamping module 1144, and globe 1064. FIG. 10A shows luminaire 1000 having an upper sectional cut-away detailed in FIG. 10B. Luminaire 1000 has capital 1072 attached to base 1071 for mounting atop a post. Capital 1072 has hingedly attached door 1081 open showing the internal components therein. Electrical assembly 1085 is removably retained on door 1081 with retainer 1037 providing easy access and removability. Electrical assembly 1085 has handle 1087 extending from an upper portion for tool-less removal. Tab 1029 is attached near an edge of door 1081 and is oriented to cooperate with tool-less latch 1028 on capital 1072 providing tool-less access to electrical gear assembly 1085, relamping module 1044, optional photo control 1075, terminal block 1076, and other components therein. FIG. 10B shows an enlarged view of the cut-away portion shown in FIG. 10A detailing the cooperation between capital 1072, dual radial sealing method having seals 1101, outer globe ring 1061, inner globe ring 1063, relamping module 1144, and globe 1064. Relamping module 1144 is shown in a sealed position within capital 1072 with a dual radial sealed socket casting, having dual radial seals 1101, section of inner globe ring 1063. Radial seals 1101 are optional as it is not required to have an air tight seal about relamping module 1144. Optionally, inner globe ring 1063 may have a single radial seal 1101. Relamping module sealing base 1030 has relamping post 1036 depending upward from a central portion and has an outer cylindrical section sealed about dual radial seals 1101. The sealing of relamping module 1144 within inner globe ring 1063 can be done with a twisting action or vertical placement of sealing relamping module base 1030 about dual radial seals 1101 environmentally sealing a lamp atop relamping post 1036 within a central portion of globe 1064. Optionally, threads are about an outer portion of the dual radial sealed socket casting section of inner globe ring 1063 which cooperate with optional threads on an inner surface of relamping module base 1030. Optional retaining bracket 1033 has a central portion engaged with relamping module base 1030 and slots in outwardly and upwardly depending flanges cooperating with retainers 1038 holding relamping module 1044 in a sealed position about dual radial seals 1101. Retainers 1038 threadingly engage and depend downwardly from outer globe ring 1061 having a head separated from outer globe ring 1061 a distance of at least the thickness of retaining bracket 1033 enabling rotating engagement of 1033 with retainers 1038. Also shown here is gasket 1012 cooperating with a lower edge of globe 1064 and located within a recess in inner globe ring 1063. The seal formed between globe 1064 and inner globe ring 1063 with gasket 1012 and the seal formed between relamping module 1144 and inner globe ring 1063 with radial seals 1101 provides tool-less access to a lamp mounted atop relamping post 1036 while providing an environmentally sealed globe 1064.

Relamping of embodiments of the post-top luminaire can be accomplished in a completely tool-less manner. For example, in this embodiment capital door 1081 is opened by releasing tab 1029 from latch 1028. Relamping module base 1030 is then released from a globe ring 1063 in a tool-less manner. In this embodiment base 1030 is rotated in a counter-clockwise direction releasing retaining bracket 1033 from retainers 1038. Relamping module 1144 is then lowered from globe 1064 exposing a lamp mounted atop relamping post 1036 allowing removal and replacement of the lamp. The lamp is then placed within the aperture in globe ring 1063 and relamping module 1144 is raised up into globe 1064 and base 1030 is secured to globe ring 1063 with a clockwise rotation. Capital door 1081 is then closed completing the relamping process.

While embodiments have been set forth for purposes of disclosure, modifications of the disclosed embodiments as well as other embodiments thereof may occur to those skilled in the art. Accordingly, the appended claims are intended to cover all embodiments which do not depart from the spirit of the disclosure.

The invention claimed is:

1. A luminaire adapted to being mounted at the top of a post comprising:

a capital having a globe mounted thereon forming an optical chamber, said capital having a front access area with a front access door hingedly attached thereto, said capital having a tool-less latch capable of holding said front access door over said front access area substantially enclosing said front access area interior of said capital;

wherein said capital has an opening in a top portion into said optical chamber of said globe, a relamping module extending upwards from said interior of said capital, through said opening and into said optical chamber and having a lamp socket;

said relamping module removable downward through said capital opening and said front access area for relamping of said globe luminaire without removal of said globe from said capital.

2. The luminaire of claim 1 wherein said tool-less latch is attached to said capital adjacent said front access area and is positioned to cooperate with a tab attached to said front access door.

3. The luminaire of claim 1 wherein said relamping module has a base sealingly cooperating with a radial sealed socket casting extending into said capital from said globe, said radial sealed socket casting has a cylindrical configuration and at least two radial seals on an outer surface thereof.

4. The luminaire of claim 3 wherein said relamping module has a relamping post extending upward from a central portion of said base, said relamping post having said lamp socket attached on an end opposite an end cooperating with said radial sealed socket casting.

5. The luminaire of claim 1 having a sealing gasket between said capital and said globe creating a seal there between.

6. The luminaire of claim 1 wherein said capital is attached to a luminaire base, said luminaire base and said capital have a sealing gasket there between creating a seal there between.

7. The luminaire of claim 1 having electrical gear attached to a tray wherein said tray is removably attached to an internal portion of said capital and is accessible from said front access area.

8. A luminaire adapted to being mounted at the top of a post comprising:

a capital having a globe mounted thereon forming an optical chamber, said capital having a globe ring with a central aperture suitable to receive a lamp, said globe ring covering the top of said capital and sealingly engaging a lower rim of said globe and sealingly engaging an upper rim of said capital, said aperture forming a top opening in said capital into said optical chamber, a relamping module extending from the inside of said capital, through said top opening in said capital and up into a said optical chamber and having a lamp socket thereon, wherein said capital has a front access area with a front access door through which said relamping module may be removed;

said relamping module removable downward through said top opening in said capital and said front access area for relamping of said globe luminaire without removal of said globe from said capital.

9. The luminaire of claim 8 wherein said relamping module cooperates with a radial sealed socket casting having dual radial seals depending from said globe ring about said aperture therein into an upper portion of said capital, said relamping module has a base sealingly cooperating with said radial sealed socket casting and is removably sealed to said radial sealed socket casting.

10. The luminaire of claim 9 wherein said relamping module has a relamping post depending upward from a central portion of said base, said relamping post has said lamp socket attached on an end opposite said base.

11. The luminaire of claim 8 wherein said capital front access door is hingedly attached thereto, said capital having a tool-less latch capable of holding said front access door over said front access area substantially enclosing said front access area.

12. The luminaire of claim 11 wherein said tool-less latch is attached to said capital adjacent said front access area and is positioned to cooperate with a tab attached to said front access door.

13. The luminaire of claim 8 having a sealing gasket between said capital and said globe creating a seal there between.

14. The luminaire of claim 8 wherein said capital is attached to a luminaire base, said luminaire base and said capital have a sealing gasket there between.

15. The luminaire of claim 8 having electrical gear attached to a tray wherein said tray is removably attached to an internal portion of said capital.

16. A luminaire adapted to being mounted at the top of a post comprising:

a capital having a globe mounted thereon forming an optical chamber, said capital having electrical gear removably attached to an internal portion of said capital wherein said capital has a front access area with a front access door attached thereto, said capital capable of holding said front access door over said front access area substantially enclosing said front access area;

wherein said capital has an opening in a top portion thereof into said optical chamber;

a relamping module which extends from the inside of said capital through said opening and up into a portion of said optical chamber and having a lamp socket thereon, said relamping module removable downward through said opening and through said access area on said capital without removal of said globe.

17. The luminaire of claim 16 including a tool-less latch attached to said capital adjacent said front access area and is positioned to cooperate with a tab attached to said front access door.

18. The luminaire of claim 16 wherein said relamping module has a base sealingly cooperating with a radial sealed socket casting extending from said globe into said capital, said relamping module removably sealed to said radial sealed socket casting.

19. The luminaire of claim 18 wherein said relamping module has a relamping post depending upward from a central portion of said base, said relamping post has said lamp socket attached on an end opposite said base.

20. The luminaire of claim 16 having a sealing gasket between said capital and said globe creating a seal there between.

21. The luminaire of claim 16 wherein said capital is attached to a luminaire base, said luminaire base and said capital have a sealing gasket there between.

22. A luminaire adapted to being mounted at the top of a post comprising a capital having a globe mounted thereon forming an optical chamber, said capital having a front access area with a front access door attached thereto, said capital having a latch capable of holding said front access door over said front access area, said capital having an opening into said optical chamber suitable to receive a lamp, a relamping module extending from the inside of said capital through said opening and up into a central portion of said optical chamber and having a lamp socket thereon, said relamping module removable from inside said capital through said opening and said front access area without removal of said globe, said relamping module having a base sealingly cooperating with a radial sealing socket and extending into said globe from said capital, electrical gear within said capital attached to a tray wherein said tray is removably attached to an internal portion of said capital.

23. An outdoor luminaire having a removable relamping module, comprising a globe sealingly mounted on a globe ring, said globe ring affixed to a capital forming an aperture extending through said globe ring and into said globe;

said capital having an interior electrical compartment accessible from an opening covered by a capital door mounted on said capital;

a relamping module removably retained on said globe ring and removable downward through said electrical compartment and said capital opening allowing said luminaire to be relamped without removal of said globe.

24. The luminaire of claim 23 further comprising an outer globe ring mounted atop said capital and substantially surrounding said globe ring.

25. The luminaire of claim 23 wherein said globe ring and said capital are integral.

26. An outdoor luminaire for mounting on a pole, comprising:

a globe sealed against a globe ring, said globe ring mounted to a capital and forming an optical chamber within said globe;

a relamping module releasably affixed to said globe ring and having a stem and a lamp socket on an upper portion of said stem, said stem extending into said globe and into said optical chamber defined by said globe and globe ring when said relamping module is installed;

said relamping module stem and lamp removable from said globe downward through said globe ring and said globe and removable from said capital through an access area coverable by an access door on said capital without removing said globe.

* * * * *